US010378842B2

(12) United States Patent
Fausti et al.

(10) Patent No.: US 10,378,842 B2
(45) Date of Patent: Aug. 13, 2019

(54) LOADING DEVICE FOR A MAGAZINE OF A WEAPON

(71) Applicant: MEC-GAR S.R.L., Gussago, Brescia (IT)

(72) Inventors: Stefano Fausti, Brescia (IT); Eugenio Pini, Brescia (IT)

(73) Assignee: MEC-GAR S.R.L., Gussago, Brescia (IT)

( * ) Notice: Subject to any disclaimer, the term of this patent is extended or adjusted under 35 U.S.C. 154(b) by 0 days.

(21) Appl. No.: 15/912,986

(22) Filed: Mar. 6, 2018

(65) Prior Publication Data

US 2018/0321004 A1 Nov. 8, 2018

(30) Foreign Application Priority Data

May 8, 2017 (IT) ..... 102017000049374

(51) Int. Cl.

| | |
|---|---|
| ***F41A 9/83*** | (2006.01) |
| ***F41A 9/67*** | (2006.01) |
| ***F41A 9/61*** | (2006.01) |
| ***F41A 9/65*** | (2006.01) |
| ***F41A 9/66*** | (2006.01) |

(52) U.S. Cl.

CPC *F41A 9/83* (2013.01); *F41A 9/61* (2013.01); *F41A 9/65* (2013.01); *F41A 9/66* (2013.01); *F41A 9/67* (2013.01)

(58) Field of Classification Search

CPC ..... F41A 9/82; F41A 9/83; F41A 9/84; F41A 9/85; F41A 9/86; F41A 9/66; F41A 9/67

USPC ..... 42/87, 88, 89

See application file for complete search history.

(56) References Cited

U.S. PATENT DOCUMENTS

| | | | | | |
|---|---|---|---|---|---|
| 1,786,537 | A | * | 12/1930 | Holek | F41A 9/83 42/87 |
| 3,087,270 | A | | 4/1963 | Stoner | |
| 3,603,020 | A | | 9/1971 | Wiese | |
| 4,152,857 | A | | 5/1979 | Ketterer | |
| 4,387,805 | A | | 6/1983 | Lanius | |
| 4,688,344 | A | * | 8/1987 | Kim | F41A 9/67 42/50 |
| 4,689,909 | A | * | 9/1987 | Howard | F41A 9/83 42/87 |
| 4,719,715 | A | * | 1/1988 | Howard | F41A 9/83 42/87 |
| 4,827,651 | A | * | 5/1989 | Conkey | F41A 9/83 42/87 |

(Continued)

FOREIGN PATENT DOCUMENTS

| | | |
|---|---|---|
| FR | 2 357 854 | 2/1978 |
| WO | 2006/133470 A1 | 12/2006 |

OTHER PUBLICATIONS

Italian Search Report for corresponding Italian Patent Application No. 102017000049374 dated Jan. 22, 2018, 8 pages.

*Primary Examiner* — Joshua E Freeman

(74) *Attorney, Agent, or Firm* — Merchant & Gould P.C.

(57) ABSTRACT

A loading device for a magazine for a firearm includes a main body and an action element projecting into the main body. The width of the inner compartment between the rear shoulder and the front shoulder is such as to allow a rotation when the upper portion of the magazine is housed in the compartment. Moreover, an adapter may be applied to the main body, so that the device may be used for different magazines.

9 Claims, 8 Drawing Sheets

(56) References Cited

U.S. PATENT DOCUMENTS 4,829,693 A * 5/1989 Holmes ..... F41A 9/83 42/87
4,993,180 A * 2/1991 Upchurch ..... F41A 9/83 42/87
5,249,386 A * 10/1993 Switzer ..... F41A 9/83 42/87
5,319,872 A * 6/1994 Bammate ..... F42B 39/00 206/3
5,355,606 A * 10/1994 Origoni ..... F41A 9/83 42/87
6,189,254 B1 * 2/2001 Steitz ..... F41A 9/83 42/87
6,219,953 B1 * 4/2001 Bentley ..... F41A 9/83 42/90
6,286,243 B1 * 9/2001 Hinton ..... F41A 9/83 42/87
7,257,919 B1 * 8/2007 Farley ..... F41A 9/83 42/87
D728,066 S * 4/2015 Tal ..... D22/199
9,212,859 B1 * 12/2015 Tal ..... F41A 9/83
D821,534 S * 6/2018 Couie ..... D22/108
D824,477 S * 7/2018 Hefer ..... D22/108
10,145,635 B2 * 12/2018 Hefer ..... F41A 9/83
2004/0020096 A1 * 2/2004 Tal ..... F41A 9/83 42/87
2004/0159035 A1 * 8/2004 Newman ..... F41A 9/83 42/87
2007/0017140 A1 * 1/2007 Pikielny ..... F41A 9/83 42/87
2007/0107291 A1 * 5/2007 Tal ..... F41A 9/83 42/87
2008/0184608 A1 * 8/2008 Tal ..... F41A 9/83 42/87
2009/0044440 A1 * 2/2009 Tal ..... F41A 9/84 42/87
2010/0175294 A1 * 7/2010 Meinel ..... F41A 9/83 42/87
2010/0187271 A1 7/2010 Selvetti
2011/0233076 A1 9/2011 Potterfield et al.
2013/0061505 A1 * 3/2013 Faifer ..... F41A 9/83 42/87
2013/0232843 A1 * 9/2013 Bajuelo ..... F41A 9/83 42/87
2018/0058785 A1 * 3/2018 Hefer ..... F41A 9/83
2018/0066907 A1 * 3/2018 Hefer ..... F41A 9/83
2018/0087856 A1 * 3/2018 Hefer ..... F41A 9/83
2018/0094888 A1 * 4/2018 Hefer ..... F42B 39/26

* cited by examiner

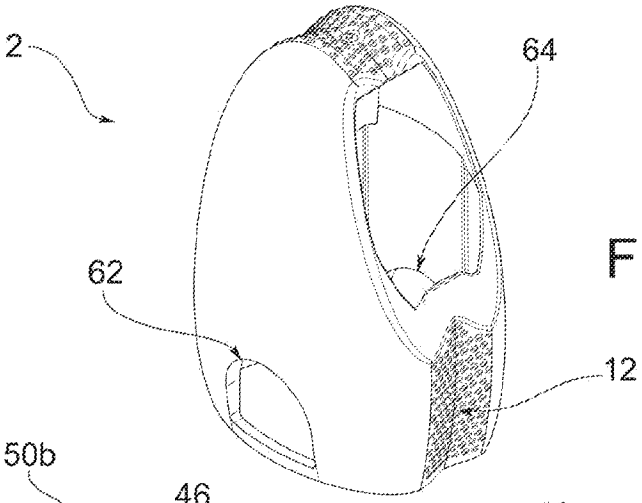
FIG.9a
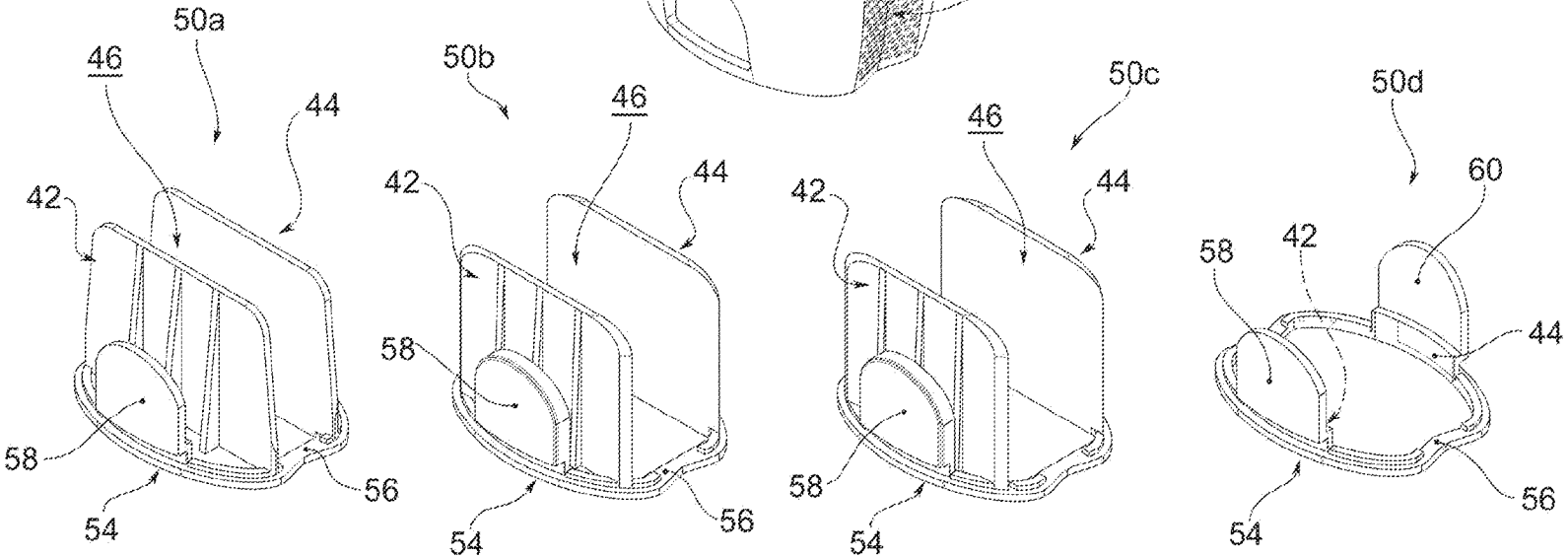
FIG.10d
FIG.10c
FIG.10b
FIG.10a

LOADING DEVICE FOR A MAGAZINE OF A WEAPON

RELATED APPLICATIONS

The present patent application claims priority of the Italian patent application for invention No. 102017000049374 of 8 May 2017, and which application is incorporated herein by reference. To the extent appropriate, a claim of priority is made to the above disclosed application.

FIELD OF THE INVENTION

The present invention is placed in the field of accessories for firearms. In particular, the object of the present invention is a device for loading cartridges into a magazine of a firearm.

As is known, a magazine of a firearm consists of a chamber open at the top and closed below by a bottom. Inside the chamber a thrust mechanism is provided, usually consisting of a follower and a spring which, resting on the bottom, pushes the follower upwards.

The cartridges are loaded manually, inserting the cartridges from the top into the chamber and using one's thumb to push them against the resistance provided by the thrust mechanism.

The loading operation becomes more and more difficult as the chamber fills up, as the resistance action exerted by the spring increases. So much so that, if several magazines are to be loaded, the operation becomes extremely tiring and difficult if one lacks the necessary strength.

STATE OF THE ART

Loading devices designed to facilitate the loading of cartridges into the magazines are known.

However, such devices have some drawbacks, such as, for example: the functional and structural complexity, especially for the models intended for professional use, with consequently significant costs for the end user; the need to intervene also with one's hand to position the cartridge correctly; the lack of effectiveness in reducing the resistance of the spring; the necessity to provide different models of devices according to the model and the caliber of the magazine.

SCOPE OF THE INVENTION

The object of the present invention is to construct a device for loading cartridges into a firearm magazine which satisfies the requirements of the sector and at the same time overcomes the drawbacks mentioned above.

This object is achieved by a loading device comprising:

- a main body consisting of a casing having an inner compartment, comprising a left side, a right side, a rear shoulder and a front shoulder, which together laterally delimit the compartment;
- an insertion opening at a lower end of the main body;
- a main opening lateral to the main body; and
- an action element projecting inside the main body from an upper end, opposite the lower end;

wherein the width of the compartment between the rear shoulder and the front shoulder is such as to allow a rotation when the upper portion of the magazine is housed in the compartment.

BRIEF DESCRIPTION OF THE DRAWINGS

The features and advantages of the loading device according to the present invention will be apparent from the description given below, provided by way of non-limiting example, in accordance with the accompanying figures, wherein:

FIG. 9*a* shows a main body of the loading device;

FIGS. 10*a* to 10*d* depict adapters applicable to the main body of the loading device.

DETAILED DESCRIPTION OF THE INVENTION

Figure 1A:
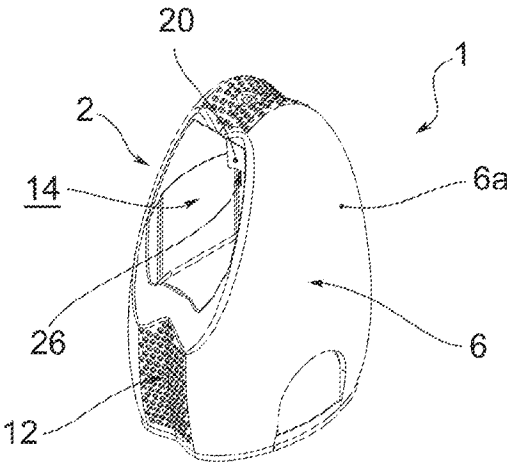
FIGS. 1*a* to 1*d* depicts a loading device according to an embodiment of the present invention.
Figure 1B:
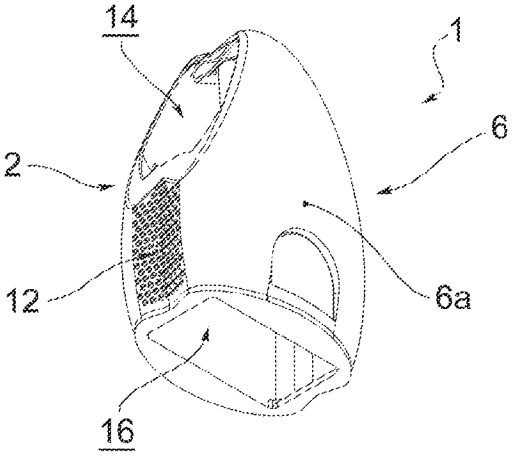
Figure 1C:
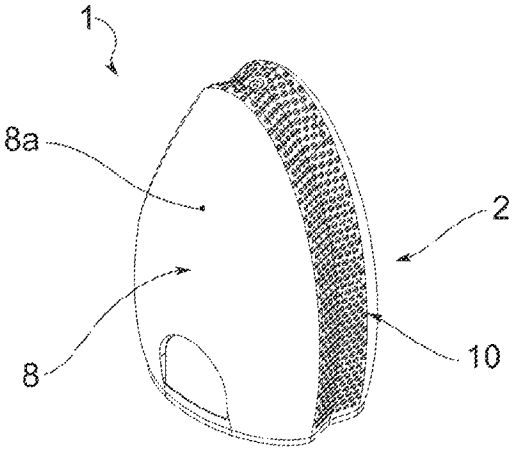
Figure 1D:
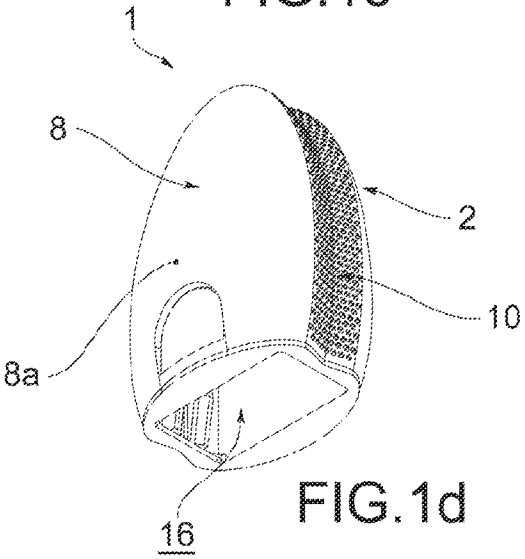
Figure 2:
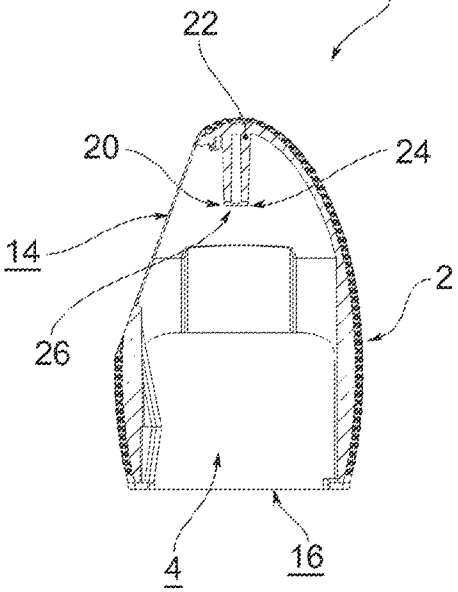
FIG. 2 shows a longitudinal sectional view of the loading device of FIGS. 1*a* to 1*d;*

With reference to the enclosed figures, a device for loading cartridges in a magazine for a firearm is indicated collectively at 1.

According to one embodiment of the invention, the loading device 1 comprises an internally hollow body 2, having an inner compartment 4 suitable to house an upper section of a magazine.

The main body 2, preferably made of plastic material, for example in one piece by injection molding, consists of a casing having a thin wall, externally shaped in an ergonomic manner to facilitate gripping with one hand, wider towards the bottom and narrower, almost pointed, at the top.

For this purpose, the main body 2 has on one side a left side 6 having a convex outer surface 6*a* to follow the typical curvature of the palm of a hand holding the body 2, wider towards the bottom and narrower towards the top; similarly, on the other side, the main body 2 has a right side 8 having an outer surface 8*a*, which is also convex.

Between the two sides 6,8, the body 2 has a rear shoulder 10, which joins the two sides at the rear for the whole extension, from the base to the top, and a front shoulder 12, which joins the two sides 6, 8 at the front, but only part way.

In this way, in the front, between the two sides 6, 8, there is a main opening 14 for inserting cartridges.

The loading device 1 is also open at the bottom, where it has an insertion opening 16 for the upper portion of the magazine, which is, for example, rectangular.

Internally, the main body 2 has an action element or shank 20, projecting from the top of the casing for a predefined length.

The shank 20 extends from an upper end 22, connected to the wall of the casing, and an opposite free end 24 which, preferably, has an arched free surface 26.

Figure 3:
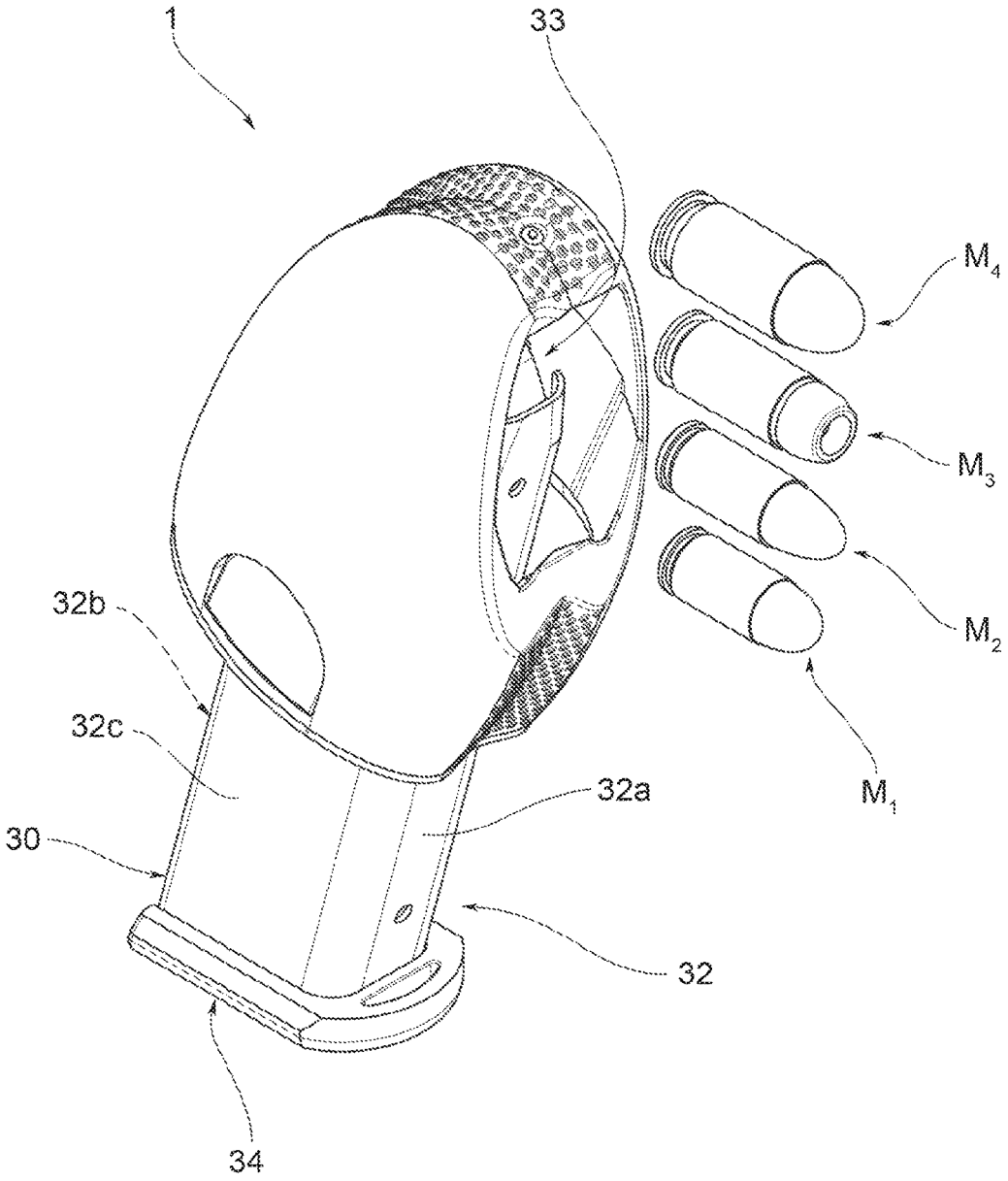
FIG. 3 depicts the loading device engaged with a magazine at the beginning of a loading operation.

With reference to FIG. 3, the loading device 1 is suitable to house therein the upper end portion of a magazine 30, usually consisting of a chamber 32 open at the top through a chamber opening 33 for loading cartridges, even of different gauges M1-M4, and closed at the bottom by a cover 34.

The chamber 32, generally with a rectangular prismatic shape, has a front face 32*a*, a rear face 32*b* and side faces 32*c*.

The magazine 30 further comprises a thrust mechanism consisting of a follower 38 and a spring, which, resting on the cover 34, pushes the follower towards the chamber opening 33.

On the top, the chamber 32 has two lips 36, 37, which partially delimit the chamber opening 33, converging with each other, so as to be able to hold a cartridge against the thrust of the follower 38.

Figure 4A:
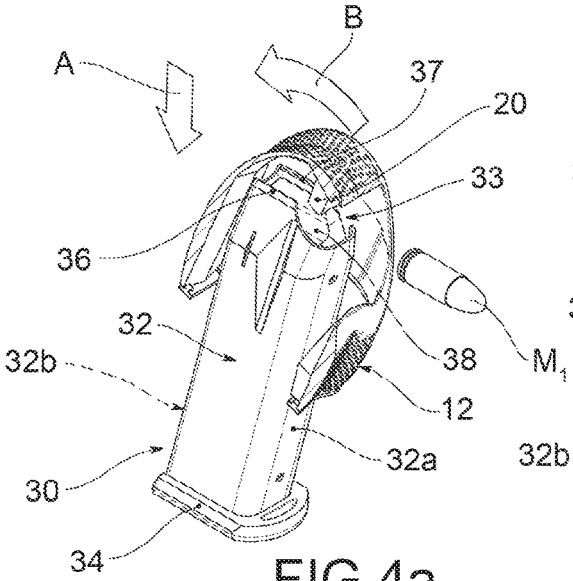
FIGS. 4*a* to 4*c*, 5*a* to 5*c*, 6*a* to 6*c*, 7*a* to 7*c*, 8*a* to 8*c* respectively represent the steps of a loading method according to the present invention.
Figure 4B:
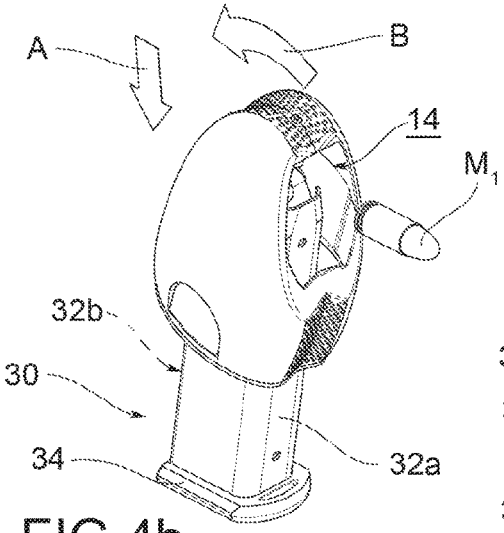
Figure 4C:
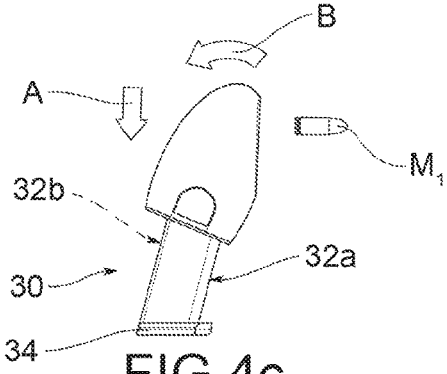

In a first stage of a loading method (FIGS. 4*a* to 4*c*), the chamber 32 is inserted into the main body 2 of the loading device 1, and the main body 2 is arranged in a front abutment position in which it is rotated in front with respect to an imaginary chamber axis; in particular, in the front abutment position, the front face 32*a* of the chamber 32 abuts the inner surface of the front shoulder 12 of the main body 2.

When the magazine 30 is in place and the device 1 is gripped, for example with the right hand, a lowering action A is carried out, pushing against the thrust mechanism.

In this way, the shank 20 operates on the follower 38 and lowers it, against the action of the spring.

Figure 5A:
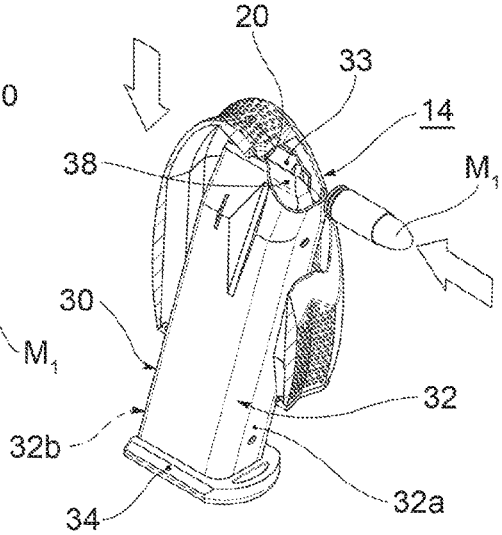
Figure 5B:
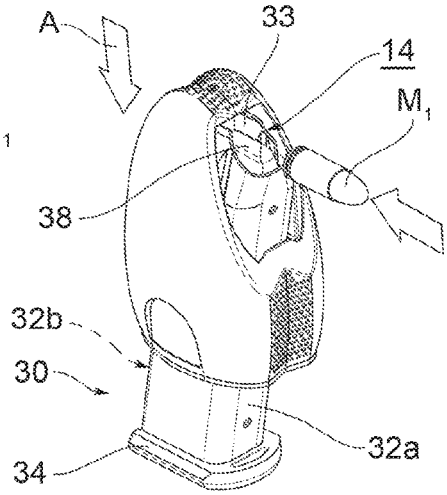
Figure 5C:
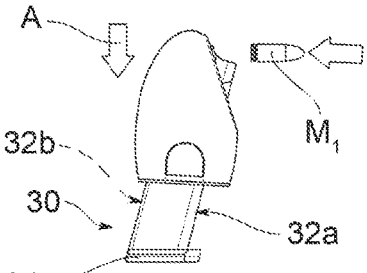

Furthermore, from the front abutment position, a rotation B or retroversion is carried out, bringing the device 1 into the rear abutment position (FIGS. 5*a* to 5*c*).

In the rear abutment position, the rear face 32*b* of the chamber 32 abuts against the inner surface of the rear shoulder 10 of the main body 2.

Maintaining the lowering action A, it is possible to introduce the cartridge M1 through the main opening 14 of the main body 2, inserting it into the chamber opening 33, between the follower 38 and the lips 36, 37 of the chamber 32; the cartridge M1 penetrates into the chamber opening 33, until it abuts against the shank 20 of the device 1, which keeps the follower 38 lowered.

Figure 6A:
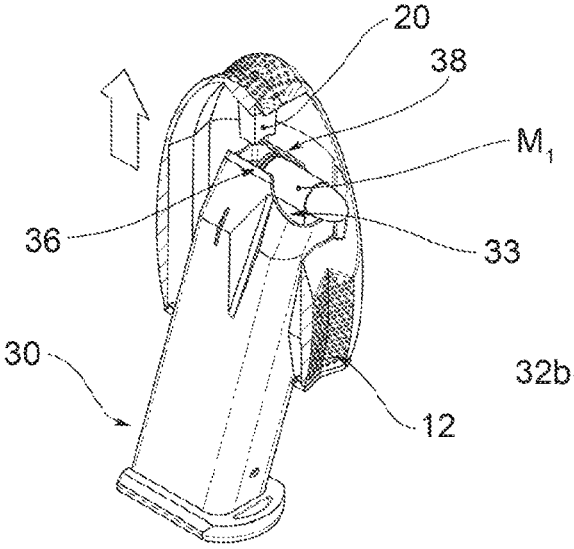
Figure 6B:
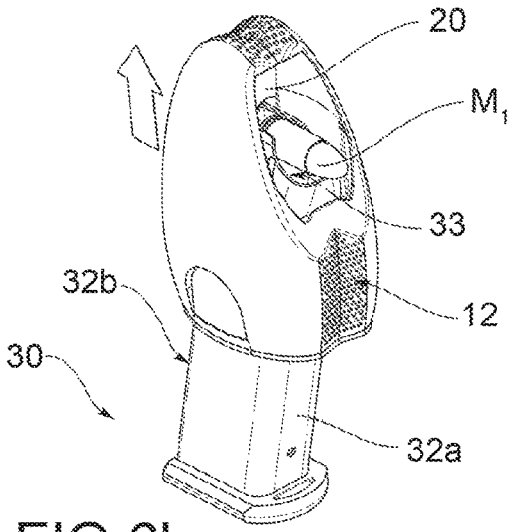
Figure 6C:
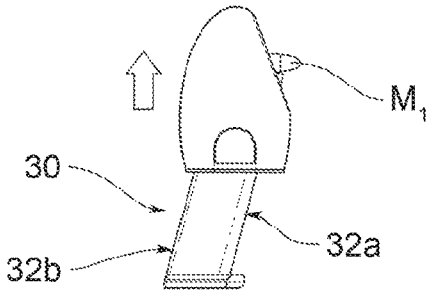

Once the device 1 is released, the follower 38 pushes the cartridge M1 against the lips 36, 37, where it remains lodged (FIGS. 6*a* to 6*c*).

Figure 7A:
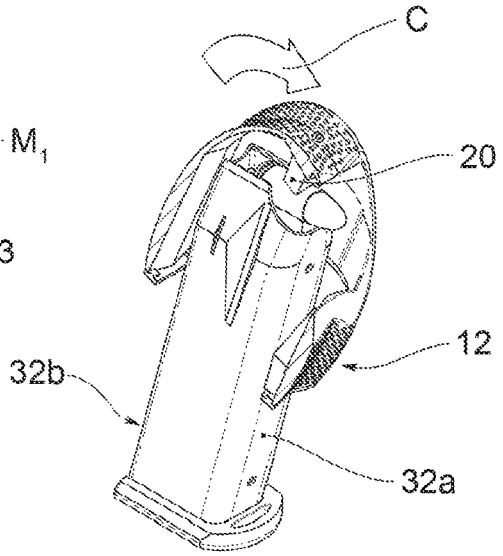
Figure 7B:
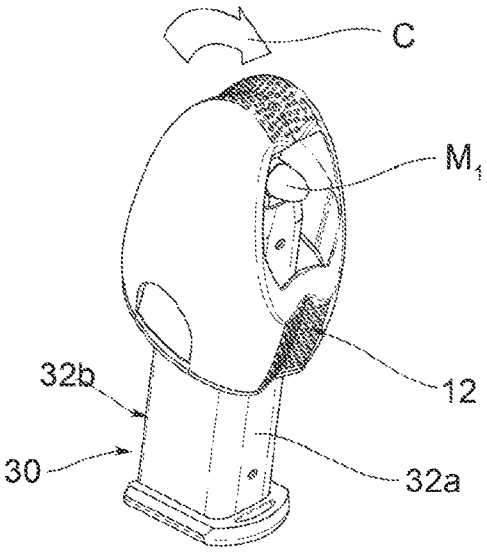
Figure 7C:
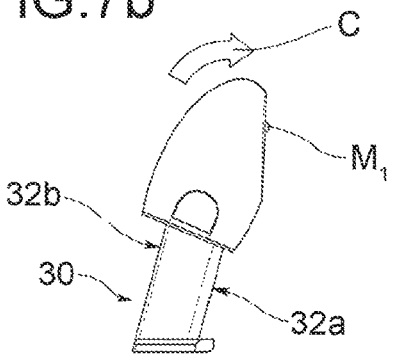

By means of an anteversion or rotation C of the device 1, the main body moves back into the front abutment position, in which the front face 32*a* abuts the inner surface of the front shoulder 12 of the main body 2 (FIGS. 7*a* to 7*c*).

Figure 8A:
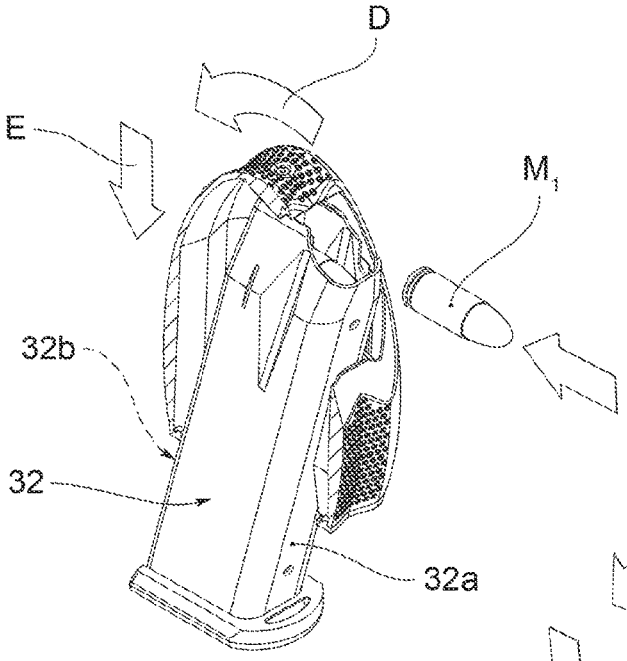
Figure 8B:
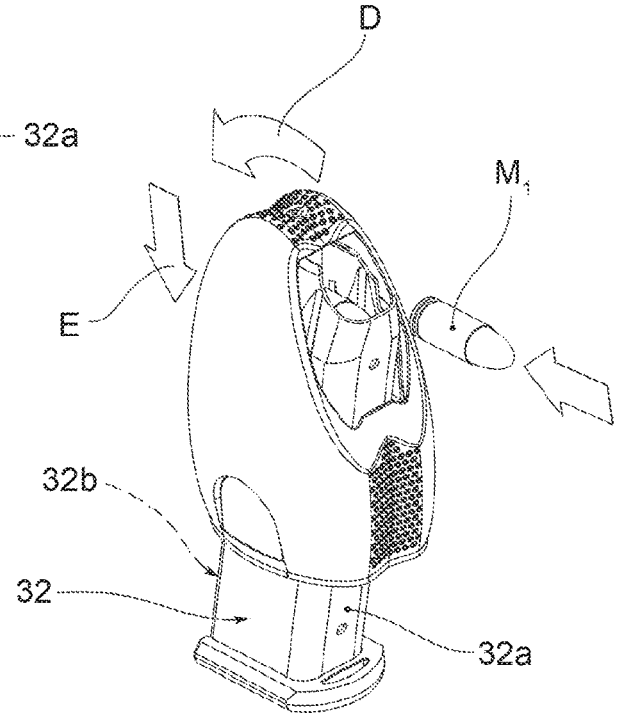
Figure 8C:
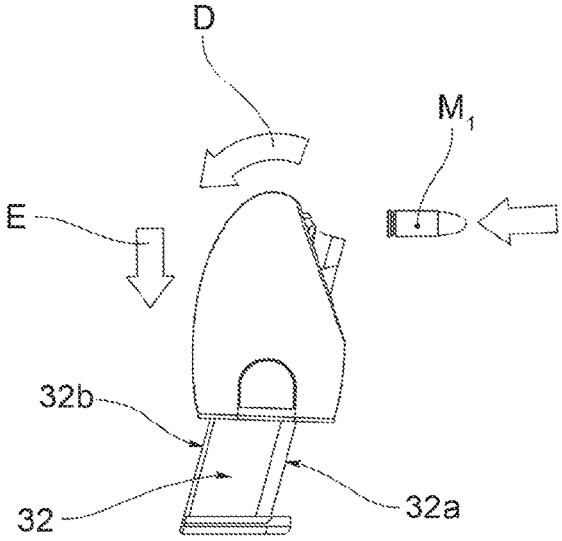
Figure 9B:
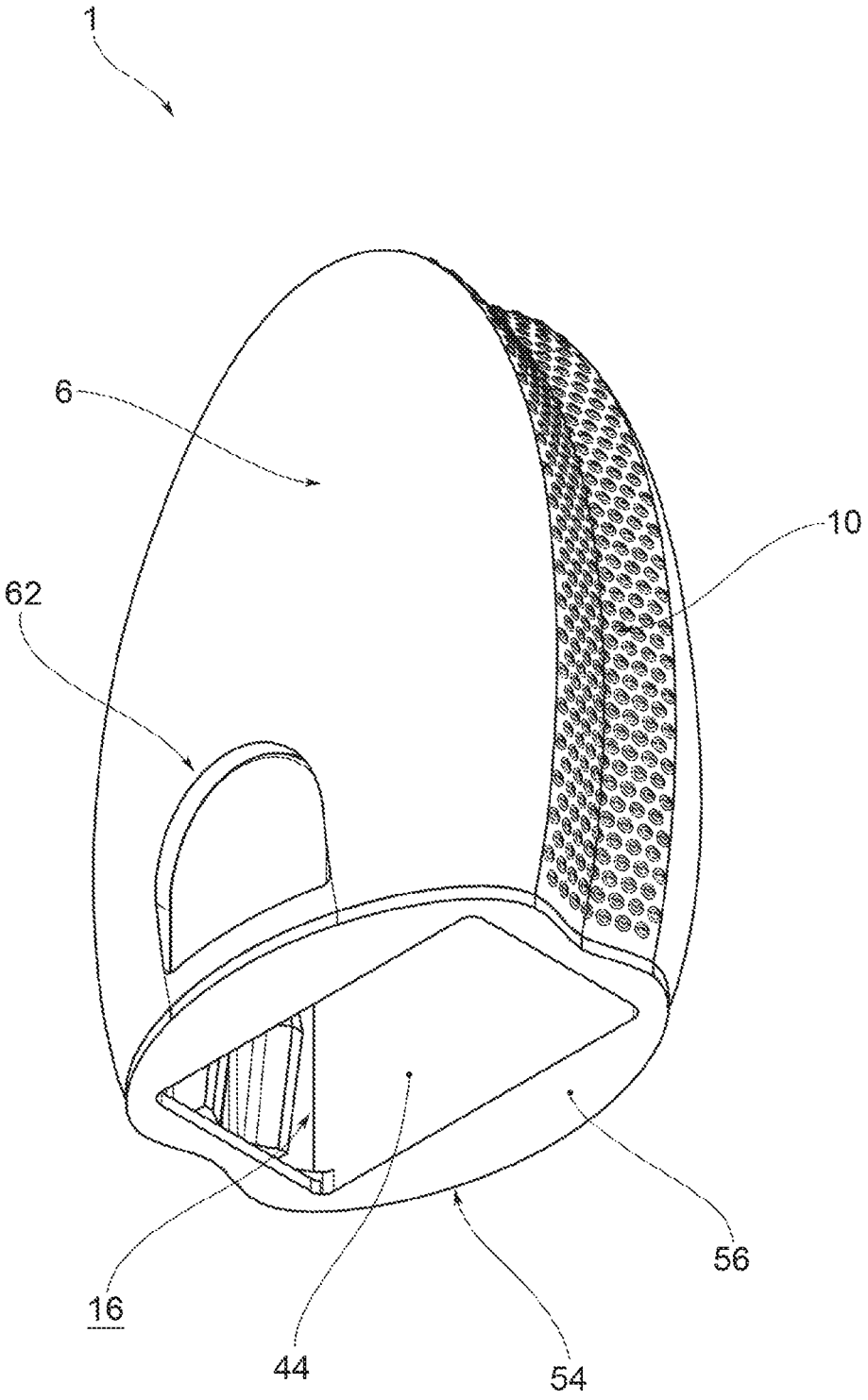
FIG. 9*b* shows the loading device equipped with an adapter.
Figure 11:
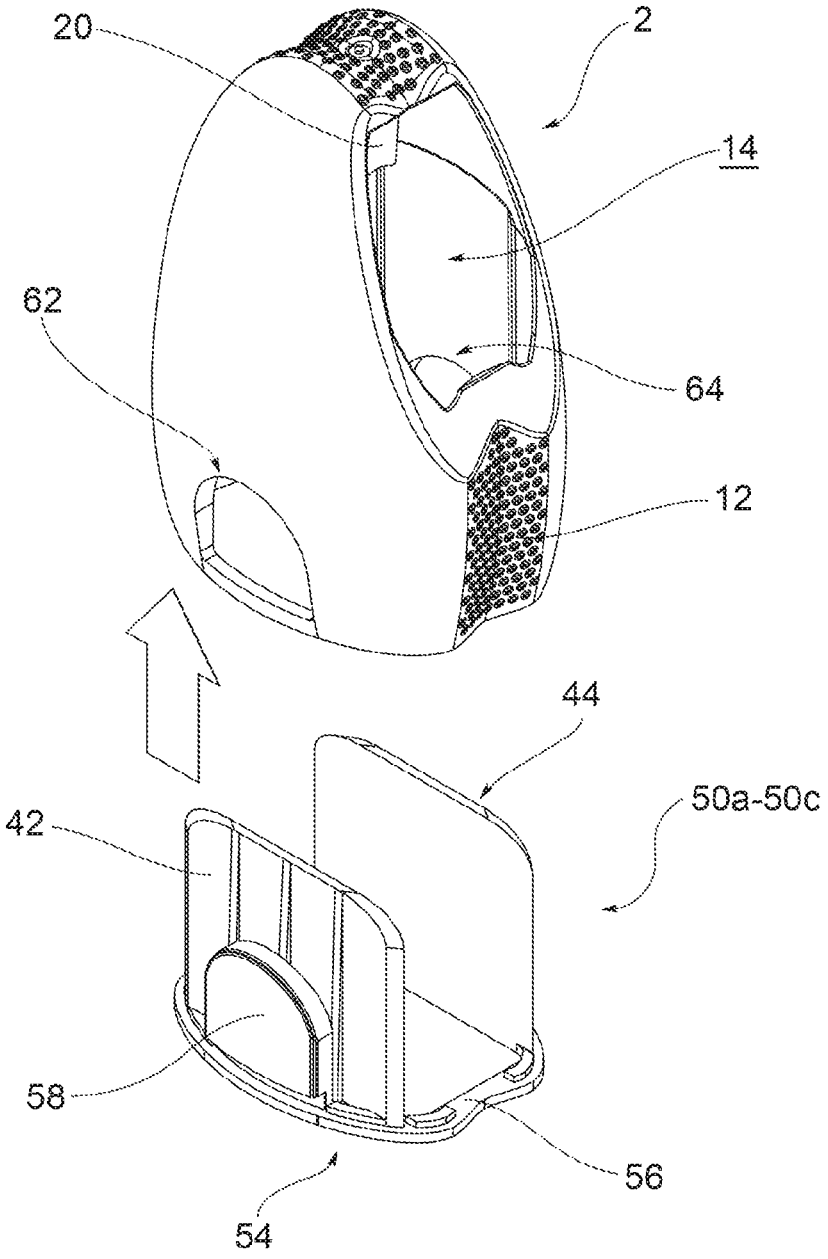
FIG. 11 illustrates the methods for applying an adapter to the main body of a loading device according to an embodiment of the present invention.

In the front abutment position, resting the shank 20 on the cartridge M1 lodged between the follower 38 and the lips 36, 37 so that the shank is on top of said cartridge, a retroversion or rotation D is carried out, at the same time pushing down again by means of a lowering action E (FIGS. 8*a* to 8*c*).

The cartridge M1, under the action of the shank 20, which preferably operates mainly by friction on the cartridge M1, moves into the final position inside the chamber 32.

By maintaining the lowering action, it is possible to insert a new cartridge M1, and thus in succession until the magazine 30 is completely loaded.

According to a further embodiment of the invention, the device 1 comprises the main body 2 and coupled facing guides 42, 44, in the form, for example, of flat walls facing each other, inside the compartment 4, adjacent to the insertion opening 16, flanked by the sides 6, 8 (FIGS. 9*a*, 9*b* and FIGS. 10*a* to 10*d*).

The facing guides 42, 44 are made so as to leave a space 46 therebetween suitable for the guided passage of the upper portion of the magazine 30. The side faces 32*c* of the chamber 32 slide against the facing guides 42, 44.

Preferably, the loading device 1 comprises an adapter 50*a*-50*d*, applicable to the main body 2, preferably snap-fitted, so as to accommodate the tabs 42, 44 in the compartment 4.

For example, the adapter 50*a*-50*d* comprises a base 54, comprising an annular wall 56 which delimits the insertion opening 16. The facing guides 42, 44 protrude from the base 54, flush with the insertion opening 16.

The adapter 50*a*-50*d* further comprises, preferably, a pair of flexible tabs 58, 60, for example projecting from the base 54, each flanked with the respective guide 42, 44.

Preferably, the adapter 50*a*-50*d* is made in a single piece, for example of plastic material, obtained by injection molding.

The main body 2 also has through-windows 62, 64, each arranged on the respective side 6, 8; the windows 62, 64 are suitable to snap-engage the tabs 58, 60.

The adapter 50*a*-50*d* may snap-engage to the bottom of the main body 2, so that the tabs 58, 60 snap-engage in the respective windows 62, 64, and the facing guides 42, 44 are located inside the compartment 4, along the sides 6, 8.

Each adapter 50*a*, 50*b*, 50*c*, 50*d*, by virtue of the distance between the facing guides 42, 44, is suitable to guide laterally a predefined magazine or a predefined group of magazines.

For one of said adapters 50*d*, the inner perimeter of the annular wall 56 acts as a guide for larger magazines.

A loading kit comprises, for example, a main body 2 and a plurality of adapters 50*a*-50*d*, so that a user may modify the loading device and use it with multiple magazines.

Innovatively, the loading device described above satisfies the requirements of the sector and overcomes the drawbacks referred to with reference to the prior art.

In effect, due to the ergonomic handle, the lowering action of the follower is less uncomfortable, while the rotation movement allows the cartridge to be positioned correctly, without intervening directly with the other hand.

Moreover, advantageously, the loading device, provided with a set of adapters, may be used for several magazines. At the same time, the operations of disassembling an adapter and applying another adapter are very simple and fast.

What is claimed is:

1. A loading device for loading a magazine of a firearm; the magazine comprising an upwardly biased follower and a chamber having a chamber axis, a front face and upper lips; the loading device comprising:

a main body comprising a casing having an inner compartment, comprising a left side, a right side, a rear shoulder and a front shoulder, which together laterally delimit the compartment;

an insertion opening at a lower end of the main body;

a main opening formed in the main body above the front shoulder; and an action element projecting inside the main body from an upper end, opposite the lower end, the action element being configured to engage the follower when lowered and to lower the follower in a front abutment position; the main body being rotatably mounted to rotate in a first direction relative to the magazine to a rear abutment position with a rear face of the magazine engaging an inner surface of the rear shoulder providing access for insertion of a cartridge through the main opening into the chamber and abutting the action element to maintain the follower in a lowered position; wherein upon release of the loading device, the follower engages the cartridge and pushes the cartridge against the upper lips; with the cartridge inserted, the main body being rotatable in a second direction opposite the first direction to the front abutment positon with the front face of the chamber abutting the inner surface of the front shoulder and the action element engaging the inserted cartridge held between the follower and the upper lips and lowers the follower; and wherein the main body is rotatable in the first direction to the rear abutment position to provide access for insertion of a further cartridge;

wherein a width of the compartment between the rear shoulder and the front shoulder is adapted to allow a rotation between the loading device and the magazine when an upper portion of the magazine is housed in the compartment.

2. Loading device according to claim 1, wherein the action element is a shank.

3. Device according to claim 2, wherein the shank has a free end provided with an arched surface.

4. Device according to claim 1, comprising facing guides, arranged in the compartment, between which a space is provided for guiding the magazine laterally.

5. Loading device according to claim 1, comprising an adapter applicable to the lower end of the main body, provided with facing guides between which a space is provided for guiding the magazine laterally, wherein the facing guides, when the adapter is applied to the main body, are arranged in the compartment.

6. Loading device according to claim 1, wherein the main body has an ergonomic outer surface for gripping by a user.

7. Loading device according to claim 6, wherein the left side and the right side have respective convex outer surfaces.

8. A loading device for loading a magazine of a firearm comprising:

a main body comprising a casing having an inner compartment, comprising a left side, a right side, a rear shoulder and a front shoulder, which together laterally delimit the compartment;

an insertion opening at a lower end of the main body;

a main opening lateral to the main body; and an action element projecting inside the main body from an upper end, opposite the lower end;

an adapter applicable to the lower end of the main body, provided with facing guides between which a space is provided for guiding the magazine laterally, wherein the facing guides, when the adapter is applied to the main body, are arranged in the compartment;

wherein a width of the compartment between the rear shoulder and the front shoulder is adapted to allow a rotation when an upper portion of the magazine is housed in the compartment; and wherein the adapter is provided with flexible tabs for releasably snap-engaging with the main body.

9. A method of loading a magazine for a firearm, the magazine comprising an upwardly biased follower and a chamber having a chamber axis, a front face and upper lips; the method comprising the following steps:

inserting a loading device on an upper portion of the magazine; the loading device comprising:

a main body comprising a casing having an inner compartment, comprising a left side, a right side, a rear shoulder and a front shoulder, which together laterally delimit the compartment;

an insertion opening at a lower end of the main body;

a main opening formed in the main body above the front shoulder; and an action element projecting inside the main body from an upper end, opposite the lower end;

exerting a lowering action on the loading device to lower a follower of the magazine and at the same time rotating the main body of the loading device in a first direction to bring the loading device into a rear abutment position with a rear face of the magazine engaging an inner surface of the rear shoulder providing access for insertion of a cartridge through the main opening into the chamber and abutting the action element to maintain the follower in a lowered position;

inserting a cartridge between the follower and upper lips of the chamber of the magazine;

releasing the lowering action, rotating the loading device in a second opposite direction to bring the loading device to a front abutment position on top of the cartridge and engaging the cartridge superficially with the action element of the loading device;

exerting a new lowering action on the loading device and rotating the device in the first direction towards a rear abutment position, to push the cartridge back towards a final position by the action element.

* * * * *